United States Patent [19]

Cummings

[11] 4,313,330

[45] Feb. 2, 1982

[54] PIPE BENDING APPARATUS

[76] Inventor: James D. Cummings, Rte. 2., Box 22, San Marcos, Tex. 78666

[21] Appl. No.: 128,576

[22] Filed: Mar. 10, 1980

[51] Int. Cl.[3] ..... B21D 9/05

[52] U.S. Cl. ..... 72/307; 72/382; 72/388; 72/398; 72/466

[58] Field of Search ..... 72/307, 308, 382, 383, 72/388, 392, 398, 465, 466, 369; 269/48.1

[56] References Cited

U.S. PATENT DOCUMENTS

| | | | |
|---|---|---|---|
| 2,347,593 | 4/1944 | Cummings | 72/388 |
| 2,943,729 | 7/1960 | Dalrymple | 72/465 |
| 3,014,518 | 12/1961 | Cummings | 72/382 |
| 3,220,719 | 11/1965 | Luker | 269/48.1 |
| 3,335,588 | 8/1967 | Cummings | 72/388 |
| 3,747,394 | 7/1973 | Cunningham | 72/466 |
| 3,964,290 | 6/1976 | Auxer | 72/466 |
| 3,979,941 | 9/1976 | Auxer | 72/466 |
| 4,027,522 | 6/1977 | Clavin | 72/466 |
| 4,088,007 | 5/1978 | Clavin | 72/466 |
| 4,164,135 | 8/1979 | Clavin | 72/466 |

*Primary Examiner*—Lowell A. Larson
*Attorney, Agent, or Firm*—Arnold, White & Durkee

[57] ABSTRACT

A pipe bending apparatus for bending thin wall pipe used in oil and gas pipelines. The apparatus includes a housing section with an upper bending die connected to its frame. Mounted within the housing section are a pair of flexible external bending shoe assemblies for clamping around the external surface of that section of pipe to be bent. The apparatus further includes a flexible mandrel aligned between the external bending shoe assemblies and adapted for being inserted into the pipe and expanded during bending operations. A positioning assembly is also connected between the mandrel and the housing section for accurately positioning the mandrel in the pipe and moving the pipe with respect to the apparatus while insuring that the bend is properly aligned. The mandrel further includes a series of slidably mounted shoe assemblies which move in a toggle-like manner to engage the inner surface of the pipe.

11 Claims, 5 Drawing Figures

PIPE BENDING APPARATUS

BACKGROUND OF THE INVENTION

1. Field of the Invention

The present invention relates generally to a device for bending pipe, and more particularly to an efficient, highly portable, pipe bending machine using an improved bending mandrel which may be used on various sizes of pipe but especially adaptable for pipe used in pipelines which transport oil and gas. The invention includes an improved mandrel which may be used to handle or shape pipe. When installing large diameter oil and gas pipelines it is often necessary to bend sections of the pipe to conform to abrupt changes in the terrain such as riverbeds or valleys. In order to make such bends, it has been found necessary to internally support the pipe during the bending operation in order to prevent deformation. Without proper internal support, the pipe wall along the outside of the bend will not expand as it should and the wall along the inside of the bend will be wrinkled or crimped. Such deformations are undesirable because it is often necessary for pipeline operators to force circular objects called "pigs" through the pipe to clear out the pipeline or separate various fluids flowing in the line. To accomplish this the pigs often have a diameter slightly greater than the pipe diameter thereby forming a seal as the pig moves along the pipe. If the pipe does not have a uniform circular cross-section over the length of the bend, the pig can become lodged within the pipe causing the entire pipeline to be shut down. Removal of such a lodged pig can be very expensive and time consuming.

In recent years the pipe used in construction of petroleum pipelines has drastically decreased in wall thickness. This use of relatively thin wall pipe has compounded the distortion problems previously experienced during bending.

Also, since the mandrel is placed inside the pipe to be bent, it has often been difficult to accurately position the mandrel.

2. Description of the Prior Art

The internal support needed to prevent pipe deformation during bending has in the past been provided by an internal pipe bending mandrel. This mandrel is placed inside the pipe and then expanded sufficiently to exert very high forces on the pipe wall in order to prevent distortion during bending.

The prior art as exemplified by U.S. Pat. Nos. 3,747,394; 3,964,290; 4,027,522 and 4,146,135 is generally illustrative of various internal mandrels. While such devices are generally acceptable for their intended purpose, they have not proven to be entirely satisfactory in preventing distortion and especially for use with relatively thin wall pipe.

U.S. Pat. No. 3,747,394 to Cunningham is representative of the pipe mandrels used in the past. This device uses a series of toggle joints securely connected to a central control device to clamp pipe engaging shoes in place against the internal portions of the pipe. Many such prior art devices have been unsuccessful in expanding the various toggle devices simultaneously and equally thereby causing unequal forces to be applied to the pipe. These unequal forces tend to increase the possibility of pipe deformation such as wrinkles and crimps. For example, the prior art has often used a lug and pin or bolt mechanism to secure the toggle joint to a common control such as the push-pull bar of Cunningham. Since it is necessary that such pins rotate within the lugs in order to create the toggle action, there exists some clearance space surrounding each pin. It has been found that, for example, in a device of the type disclosed in U.S. Pat. No. 3,747,394, this clearance space in each toggle joint causes a wave like movement of the shoes as the mandrel is expanded. This unequal application of the force from the shoes is particularly troublesome when thin walled pipe is bent. Often wrinkles and crimps result from such bends. Also, this problem of non-simultaneous movement of the pressure applying shoes is often compounded after the mandrel has been used for an extended period of time. After some use, components of many of the prior art devices have become worn or bent and therefore may fail to function properly.

Another problem which has persisted in the industry deals with non-aligned bends. The bending operation itself is typically performed by actually bending a small section of the pipe such as one or two feet then advancing the machine with respect to the pipe and the adjacent section is bent. However, it has often been a problem that the pipe is allowed to rotate or twist a small amount between each such bending operations. As a result of this twisting between the incremental bends, the entire section of pipe may be bent in a non-aligned or skewed manner.

As a result of the shortcomings of the prior art typified by the above, there has developed and continues to exist a substantial need for a pipe bending machine which can be used with relatively thin wall pipe while providing sufficient and yet uniformly applied internal support in order to prevent pipe distortion and skew during bending. Despite this need, and the efforts of many individuals and companies to develop such a device, a simple, compact machine which includes a mandrel capable of being accurately positioned and uniformly applying internal support to a pipe has heretofore been unavailable.

The problems enumerated in the foregoing are not intended to be exhaustive but rather are among many which tend to impair the effectiveness of previously known pipe bending machine and mandrels. Other noteworthy problems may also exist; however, those presented above should be sufficient to demonstrate that mandrels appearing in the art have not been altogether satisfactory.

SUMMARY OF THE INVENTION

Recognizing the need for an improved pipe bending apparatus, a feature of the present invention pertains to the uniform and simultaneous application of external and internal support forces by external shoe assemblies and a pipe mandrel. This uniformly applied force prevents the pipe from creasing or wrinkling at any point along the portion of the pipe being bent.

An additional feature of the present invention is the incorporation of a pair of flexible external shoe assemblies which are used to clamp around the external surface of the pipe and maintain the pipe's circular cross-section during bending.

A further feature of the present invention is the use of shoe assemblies in a mandrel which are slidably mounted on a central bar thereby enabling the simultaneous and uniform movement of each shoe assembly which clamps the mandrel in place within the pipe.

A still further feature of the present invention involves the use of a plurality of shoe assemblies interposed between a series of spacer assemblies all slidably mounted on a central push-pull bar. By slidably mounting these elements on the bar, movement of the shoe assemblies is accurately controlled by the operator.

The present invention is summarized in that an improved pipe bending apparatus includes an overall frame having an upper bending die connected to the frame. Also carried by the bending frame are an upper and lower external bending shoe assemblies which are adapted for clamping the outer surface of the pipe to be bent. The apparatus further includes a mandrel which is aligned between the upper and lower external shoe assemblies and positioned within the pipe. The mandrel is adapted for controllably expanding within the pipe and maintaining a circular cross-section of the pipe during bending. The mandrel includes a series of shoe assemblies which are mounted on a central bar for sliding movement relative to the bar. A positioning assembly is also connected between the mandrel and the overall frame. This positioning assembly is arranged to accurately position the mandrel within the pipe and selectively move the pipe after completion of a portion of the bending operation.

BRIEF DESCRIPTION OF THE DRAWINGS

So that a manner in which the above recited features and advantages of the present invention, as well as others, which will become apparent, are attained and can be understood in detail, a more particular description of the invention, briefly summarized above, may be had by reference to the embodiment thereof which is illustrated in the appended drawings, which drawings form a part of this specification.

It is to be noted, however, that the appended drawings illustrate only a typical embodiment of the invention and are therefore not to be considered limiting of its scope, for the invention may admit of other equally effective embodiments.

DETAILED DESCRIPTION OF A PREFERRED EMBODIMENT OF THE INVENTION

Figure 1:
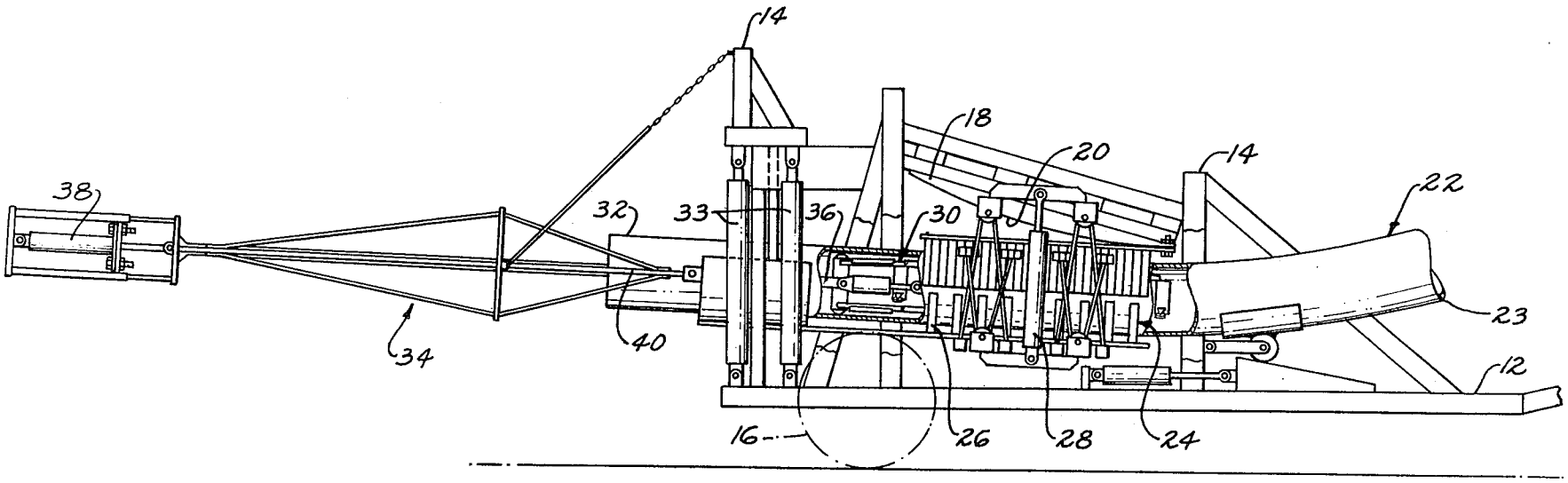
FIG. 1 is a schematic elevation view of the apparatus as a whole showing the mandrel positioned within the pipe to be bent.

Referring to FIG. 1 of the drawings, a pipe bending machine constructed according to a preferred embodiment of the invention may be seen to comprise a housing section having a base section 12 with front and rear vertical supports 14. The housing section may be mounted on wheels 16 for easy movement between operations. Mounted across the upper portion of the vertical supports 14 is an upper bending die 18. The lower portion of the bending die forms an arcuate surface 20 which determines the amount of bend to be placed in the pipe 22. This bending die 18 is of conventional design and needs little additional explanation to those skilled in the art.

Attached to the housing section beneath the bending die 18 is a pair of flexible, external bending shoe assemblies 24. Each external shoe assembly contains a series of arcuate shaped external shoes 26 which are adapted for engaging the outer surface of the pipe when it is placed between the shoe assemblies as seen in FIG. 1 and brought into contact with the pipe by activation of a power supply such as for example piston and cylinder 28.

An internal mandrel which can be inserted into the pipe as the pipe 22 is placed into the machine is shown generally at 30. A detailed description of the mandrel 30 will follow. The mandrel 30 itself is aligned between the external bending shoe assemblies 24 and within the pipe 22. The mandrel 30 is capable of being expanded within the pipe while the external bending shoe assemblies 24 are clamped around the outer surface of the pipe. After placing the pipe in total compression through the use of flexible shoe assemblies 24 and an internal mandrel 30, end 32 of the pipe 22 is elevated by activation of a second power supply such as pistons 33 with respect to the other end thereby forcing at least a portion of the section of the pipe within the flexible external shoe assemblies 24 against the upper surface 20 of the bending die 18. Such movement forces the pipe 22 to be bent to conform to the arcuate surface 20 of the die 18. Upon lowering of end 32 of pipe 22, the pipe retains the bent shape since the mandrel is sufficiently flexible. Although a large section of the pipe could be bent, it has been determined that it is preferable that a small section such as one foot be bent during each operation. The pipe is then advanced one foot after each bending operation.

The apparatus also includes a positioning assembly 34 connected between the mandrel 30 and the housing section. This assembly accurately positions the mandrel 30 within the pipe 22 and may be used to move the pipe 22 with respect to the external bending shoes 26 between operations.

The positioning assembly 34 includes a drive shaft 36 connected to the mandrel 30 and extending centrally of the pipe 22 and out end 32. Connected to the outer end of the drive shaft 36 is a drive means 38. One form of such a drive means is a piston and cylinder unit operated hydraulically or pneumatically. By movement of the piston, the drive shaft 36 and therefore the mandrel 30 may be moved longitudinally within the pipe 22. The drive means 38 is attached to an external support bracket 40 which is mounted to the housing section. This bracket 40 supports the drive means 38 and drive shaft 36. Since bracket 40 is attached to the housing and vertical support 14, movement of the drive means 38 causes the drive shaft 36 to move relative to the housing. If the mandrel 30 is in the expanded position and is securely engaging the inner surface of the pipe 22 with the external shoe assemblies not engaging the pipe, activation of the drive unit 38 may be used to move the mandrel 30 and pipe 22 relative to the housing. Therefore, the drive means 38 can be used to selectively position the pipe 22 relative to the apparatus itself. After the pipe is properly positioned, the mandrel 30 may then be placed in its retracted position and the drive means 38 reactivated to move the mandrel longitudinally within the pipe and realign it within the pipe between the external bending assemblies 24. The mandrel 30 and pipe 22 are then positioned for the next bending operation. Thus, the positioning assembly 34 is used both to properly position the mandrel 30 within the pipe 22 and to move the pipe 22 with respect to the housing a predetermined amount after each bending operation. The positioning assembly therefore allows the operator to know the exact location of the mandrel 30 within the pipe at all times and to move the pipe through the machine as it is bent.

Another unique feature of the apparatus is the ability to prevent rotation of the pipe 22 between bending operations. As previously described, the pipe 22 is at all times engaged by either the external bending shoe assemblies 26 or the mandrel 30. The mandrel 30 engages the pipe as it is moved through the apparatus between each bending step and the external shoe assemblies 26 engage the pipe while the mandrel 30 is being positioned within the pipe. This ability to constantly engage the pipe prevents rotation of the pipe between bending steps. This rotation is particularly acute as the pipe is bent over a longer length causing one end of the pipe (end 23 shown in FIG. 1) to be elevated with respect to the opposed end. This rotation causes the next bending step to not be aligned with the previous bent section causing a skewed bend in the overall pipe.

Figure 2:
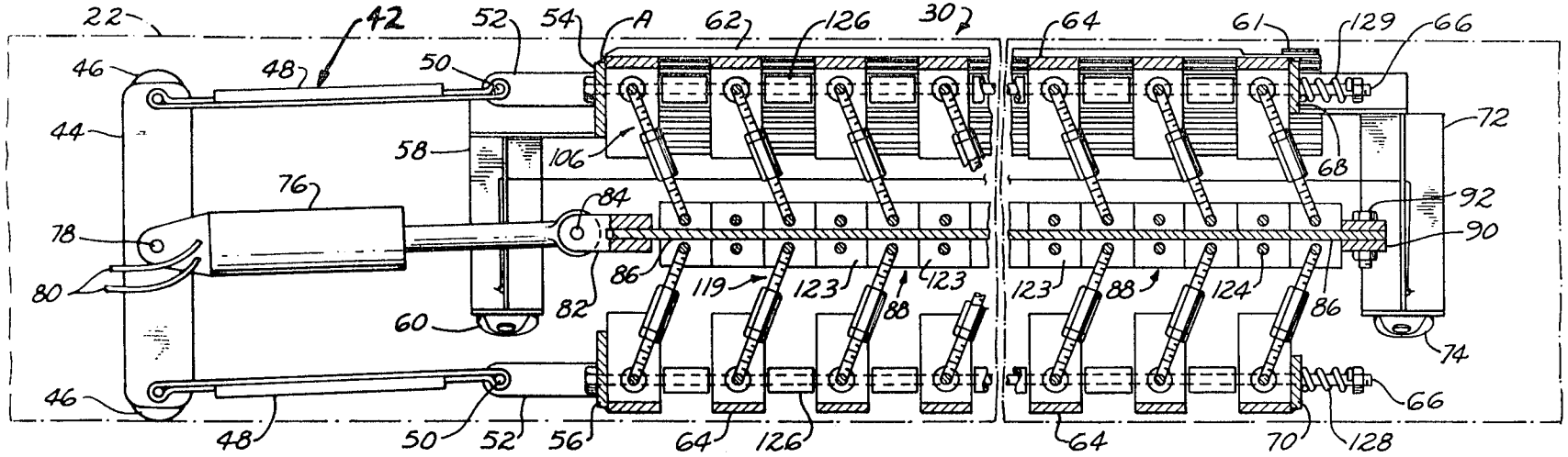
FIG. 2 is a cross-sectional view through a pipe to be bent showing a side elevation of the mandrel within the pipe as the mandrel appears in its retracted position.

Referring to FIGS. 2 through 5, a preferred embodiment of the mandrel 30 for insertion into pipe 22 which is to be bent is shown. The primary purpose for mandrel 30 is to maintain the pipe's uniform circular shape during bending operations. However, it should be understood that the mandrel 30 could be used to apply force within any circular member such as to grip a pipe for handling operations or to reform a pipe which has become dented or compressed into a non-circular cross-section. The mandrel 30 itself has a frame section 42 to which the various elements are attached. The frame section 42 includes a series of support elements such as the end member 44 which has a first set of guide or support wheels 46 axially mounted on its upper and lower extremities. When the mandrel 30 is placed inside the pipe 22, these guide wheels 46 roll along the internal surface of the pipe and allow the mandrel 30 to be easily positioned when in the retracted position as shown in FIG. 2.

In the particular device illustrated in FIG. 2, the frame section 42 further includes a pair of frame braces 48 pivotally connected to each end of the end member 44 with the other end of each frame brace 48 pivotally connected by pin 50 to lugs 52 attached to upper and lower end plates 54, 56. Also attached to the upper end plate 54 and extending downwardly and angularly are braces 58 having a second set of guide or support wheels 60 mounted thereon. As can be appreciated, this second set of guide wheels 60 also assist positioning the mandrel 30 within the pipe 22.

The frame section 42 also includes a series of slender, elongated shoe strips 62 having one end attached to the upper end plate 54 at point A, the remainder of the strips being free to slide longitudinally along the top of each shoe assembly 64 during bending operations. The opposed end of strips 62 are slidably retained by band 61. These shoe strips 62 directly engage the inner surface of the pipe 22 when the mandrel 30 is in the expanded position of FIG. 5 and extend substantially the entire length of the mandrel body. These strips may be made of any suitable material such as spring steel which must be of sufficient flexibility to conform to the inner surface of the pipe during bending operations yet of sufficient strength to withstand high compressive forces during use. The above-described components of the frame section 42 are retained together by a plurality of tie-rods 66 which pass longitudinally of the mandrel 30 through upper and lower end plates 54, 56, shoe assemblies 64 and upper and lower front plates 68, 70 as illustrated in FIG. 2. A more detailed description of tie-rods 66 and shoe assemblies 64 is provided below. Attached to the upper front plate 68 are front support braces 72 having a third set of guide wheels 74 axially mounted on the support braces 72 for use during insertion of the mandrel 30 when in the retracted position shown in FIG. 2.

One of the features of the present invention as shown in FIG. 2 is a power supply unit 76 pivotally attached to end member 44 by a pin 78. In the embodiment illustrated in FIG. 2, the power supply unit 76 takes the form of a piston and cylinder unit which may be hydraulically or pneumatically operated through conduits 80. The outer end of the shaft of the piston and cylinder unit is connected to a bracket 82 by pivot pin 84. The bracket 82 is connected to one end of an elongated, flexible rod or flat strap or strip 86 which extends longitudinally along the central axis of the mandrel 30. The rod 86 may be fabricated of a suitable material such as for example spring steel since it must also bend during bending operations yet retain its original shape.

Figure 3:
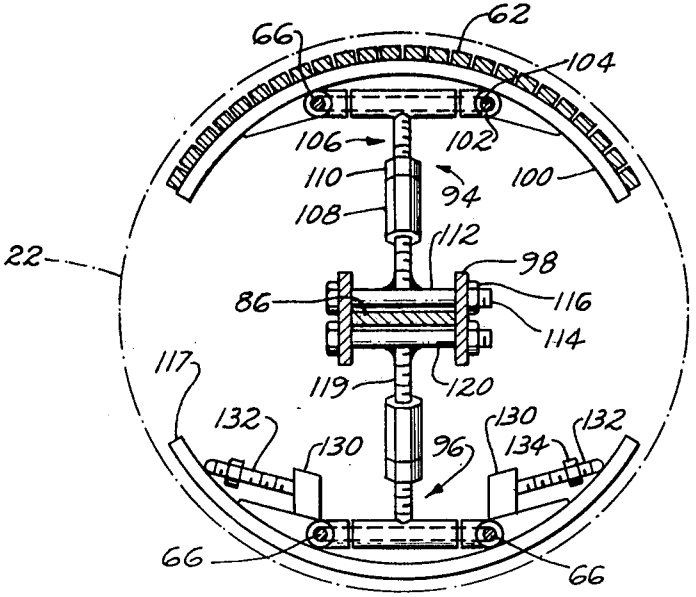
FIG. 3 is a view showing the details of a single shoe assembly mounted on the central bar.

As can be seen in FIGS. 2 and 3, a plurality of shoe assemblies 67 are mounted on the rod 86, each shoe assembly 64 being free to slidably move with respect to the rod 86. Interposed between each of the shoe assemblies 64 and also slidably mounted on the rod 86 is a series of spacer assemblies 88. At the end of the rod 86 opposed from the power unit 76, is attached a retaining block 90 held in position by a fastener such as the bolt and nut 92. This retaining block 90 prevents the shoe assemblies 64 and spacer assemblies 88 from sliding off the end of the rod 86 during operation.

Turning now to FIG. 3, a shoe assembly 64 slidably mounted on rod 86 is shown in detail. Each shoe assembly 64 includes an upper internal shoe 94 and a lower internal shoe 96 pivotally connected together by a pair of spacer blocks 98. Each upper internal shoe 94 includes an arcuate segment plate 100 having a pair of lugs 102 welded to its inner, concave surface, each lug 102 having a hole 104 through which the tie-rod 66 is slidably inserted. Shoe strips 62 are positioned along the outer surface of the upper shoe assembly 94 as shown in FIG. 3 and engage the inner surface of the pipe when the mandrel 30 is expanded.

Rotatably mounted between the lugs 102 of the plate 100 and extending inwardly toward the longitudinal centerline of the mandrel 30 is an I-shaped connector bar 106. In the embodiment shown in FIG. 3, means for adjusting the length of connector bar 106 is disclosed, such means taking the form of a threaded turn-buckle adjustment nut 108 and lock nut 110. However, as can be appreciated, other means for adjusting the length of the connector bar 106 may be provided. The connector bar 106 also includes a base crosspiece 112 connected between the spacer blocks 98 and adapted for pivotally rotating the entire connector bar 106 about the longitudinal axis of the crosspiece 112. Each end of the crosspiece is equipped with threads 114 enabling the spacer blocks 98 to be retained in position by a nut 116.

Figure 4:
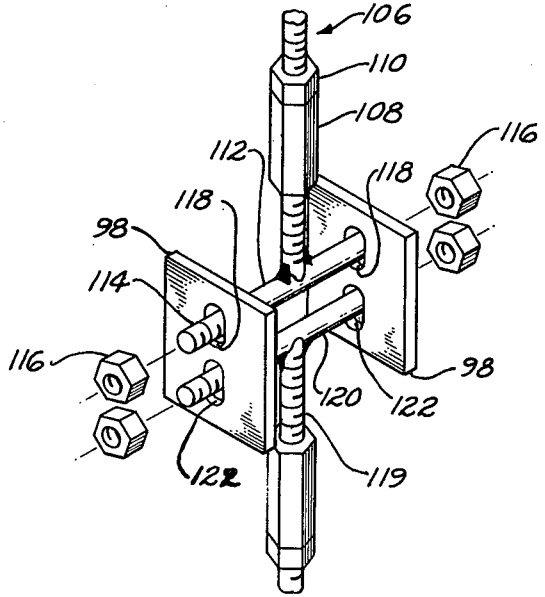
FIG. 4 is a detailed view showing the connection between the spacer blocks and connecting rods.

As shown in more detail in FIG. 4, each threaded end portion 114 of the crossbars 112 passes through a transverse slot 118 in the adjacent spacer blocks 98 and held in position by nut 116. It will be noted that each slot 118 has a width substantially equal to the diameter of the threaded portion of the crosspiece 112. Such an arrangement allows the crosspiece 112 to move up and down slightly as shown in FIG. 4 in a direction perpendicular to the longitudinal axis of the mandrel 30 while minimizing movement in a direction parallel to the mandrel's longitudinal axis.

The lower shoe 96 as shown in FIG. 3 is substantially identical to the upper shoe 94 and includes a lower arcuate segment plate 117 rotatably connected to a lower connector bar 119 with crossbar 120 pivotally connected to common spacer blocks 98. The crossbar 120 of the lower shoe 96 is also rotatably mounted in a pair of slots 122 in the common spacer block 98 which allows the connector bar 120 to move slightly in a radial direction as previously described. As can be understood, the two slots 118, 122 in each spacer block 98 may be replaced with a longer, single slot with both upper and lower crosspieces 112, 120 being inserted therein. Also, even though aperture 118 is shown as a slot, it can be readily understood that the specific shape of this aperture may vary depending on the needs of the operator or manufacturer.

In addition to the adjustment which is obtainable with turn-buckle 108, the lower shoe 96 may include a means for making adjustments in the direction transverse to that of turn-buckle 108. As shown in FIG. 3 a pair of lugs 130 are connected to the arcuate segment 117. Threaded into lugs 130 is an adjustment bolt 132 with an adjustment nut 134 fixed thereto. The opposed end of bolt 132 contacts the end of segment 117. As can be understood, the operation may adjust the size of the lower shoe 96 by simply rotating bolt 132 which contacts segment 117 and forces segment 117 outwardly or allows it to spring inwardly depending upon the specific size of the pipe into which the mandrel 30 is inserted. Although not shown, similar adjustment means may be connected to the upper shoe 94 to insure that it fits properly against the internal surface of the pipe.

As can be seen in FIG. 3, the bar 86 passes through the opening or passage formed by the upper crossbar 112, lower crossbar 120 and the connecting spacer blocks 98. Since the distance between the upper and lower crosspieces 112, 120 is free to vary between an amount less than the thickness of the bar 86 to an amount greater than the thickness of bar 86, the entire shoe assembly 64 may be slid along the bar 86 when the crosspieces 112, 120 are properly shifted. However, when both upper and lower connector bars 106, 119 are positioned substantially vertically with compressive loads exerted thereon as a result of the mandrel 30 being expanded, as in the position of FIG. 5, each crosspiece 112, 120 rests directly on and contacts the bar 86 and are not supported by the spacer blocks 98. Such an arrangement thereby causes these large compressive forces to be transmitted directly to the bar 86 without placing excessive forces on the spacer blocks 98 or the crosspieces 112, 120. Since each upper connector bar 116 is aligned with its corresponding lower connector bar 119, the forces exerted by each on the bar 86 are aligned and essentially counteract each other causing no bending moment on bar 86 but only pure compression.

Interposed between each shoe assembly 64 and also slidably mounted on the bar 86 are spacer assemblies 88. Each spacer assembly 88 includes spacer blocks 123 similar to the spacer blocks 98 used in each shoe assembly 64. These spacer blocks 123 are connected together by an upper and lower bolt assembly 124 as seen in FIG. 2.

It should be appreciated that spacer blocks 123 used in each spacer assembly 88 and the blocks 98 used in each shoe assembly 64 are of substantially uniform dimension, as for example all blocks having a length of substantially two inches. This uniform dimension is preferred in order to insure proper spacing and movement of each shoe assembly 64 during bending operations.

As can now be better understood, the tie-rods 66 pass through each shoe assembly 64 and maintain the plurality of shoe assemblies 64 in proper spaced orientation while allowing the mandrel 30 as a whole to be very flexible. FIG. 2 shows tie-rods 66 passing through each shoe assembly 64 with circular spacers 126 interposed between each lug 102. These circular spacers 126 are also of predetermined length and assist retaining each shoe assembly 64 in proper position. Since the lower portion of the mandrel 30 as seen in FIG. 2 must expand in length during bending operations, a spring 128 is placed on the end of each of the lower tie-rods 66. These springs 128 enable the lower portion of the mandrel 30 to expand during bending yet retain its proper spacing when returned to the retracted position. A similar spring 129 is placed on the upper tie-row to retain its proper position during bending also.

Operation of the pipe bending mandrel 30 will now be discussed. The mandrel is supported by guide wheels 46, 60 and 74 as it is placed in position within the pipe 22. During this initial positioning, the mandrel 30 is in the retracted position as shown in FIG. 2. Once the mandrel 30 is positioned within the pipe 22 and aligned between the external shoe assemblies 26 where the bend is desired, the power unit 76 is activated through conduits 80 and shifts or pulls the bar 86 from right to left as shown in FIG. 2. However, it can be appreciated that upon proper orientation of the shoe assemblies 64, the mandrel 30 may be made to operate by shifting bar 86 from left to right. This movement causes each of the spacer blocks 98, 123 mounted on the bar 86 to slide toward the retaining block 90 until all blocks are "squeezed together" and contacting each adjacent block. Once all the space between adjacent blocks has been eliminated by this sliding motion, further movement of the bar 86 in the same direction causes each of the shoe assemblies 64 to expand radially in a toggle-type action, the upper and lower connector bars 106, 119 joined by spacer blocks 98 forming a toggle joint. Since all space between adjacent spacer blocks 98, 123 slidably mounted on the bar is eliminated prior to applying any effective straightening force to the toggle joint, all shoe assemblies 64 are placed in the required, predetermined spaced relationship prior to any outward movement of the shoe assemblies 64 and therefrom all shoe assemblies 64 are expanded simultaneously at the same rate when the bar 86 continues to move an additional amount. It has been found that use of the spacer blocks 98, 123 to slidably mount the shoe assemblies 64 onto the bar 86 enables this simultaneous movement regardless of the location of the individual shoe assembly 64 along the length of the bar 86. This accurate positioning of the shoe assemblies 64 is also accomplished even after extended use of the mandrel 30 since little or no clearances are needed in the assembly or any deformation of pins or bolts occurs. Such simultaneous expansion has been found to be important in assuring the elimination of waves or wrinkles in the pipe 22.

Figure 5:
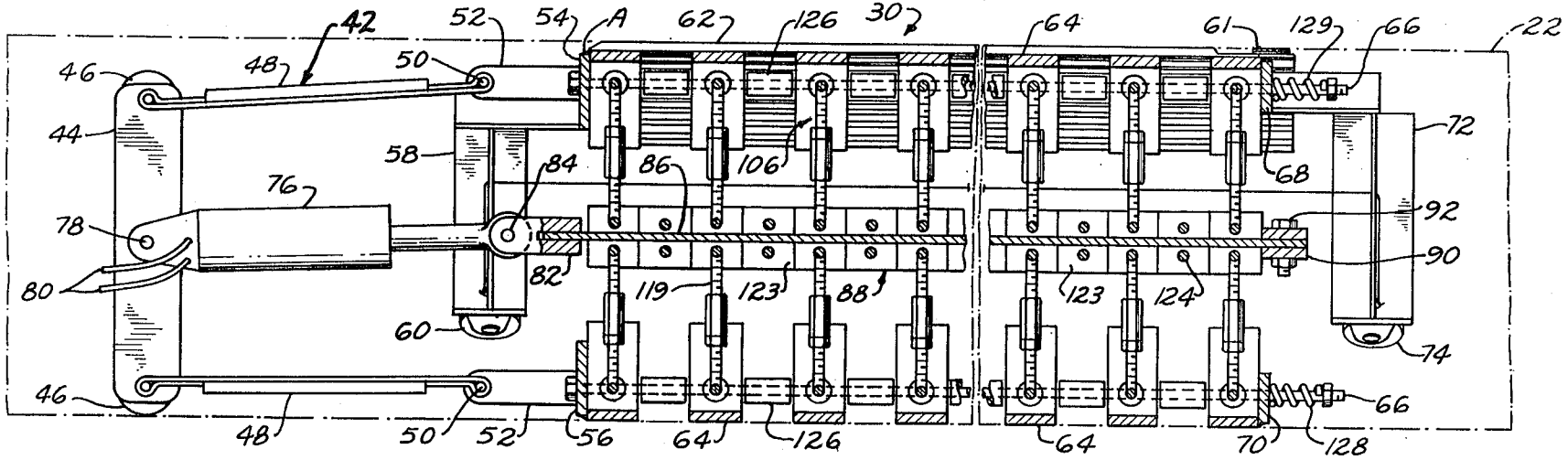
FIG. 5 is similar to FIG. 3 but showing the mandrel in an expanded position.

As seen in the expanded position of FIG. 5, the toggle like movement of each assembly 64 as a result of a longitudinal force being applied to each spacer block 98, 123, causes each connector bar 106, 119 to be rotated and bring the upper and corresponding lower connector bars into alignment. This aligning of the connector bars 106, 119 causes each of the arcuate segments 100, 117 to be thrusted radially outwardly in opposite directions, the upper segment 100 clamping the strips 62 against the inner surface of the pipe along the length of the mandrel. Such expansion also causes the lower arcuate segments 117 to contact the inner surface of the lower portion of pipe. Also, in the expanded position the upper and lower connector bars 106, 119 are aligned and, ad discussed, directly contact or rest on the bar 86. The use of spacer blocks 98 with slots 118, 122 allows the large compressive forces generated by the toggle-like action to be communicated directly to the bar 86 as opposed to any lug connecting pin or other connection which could become worn or bent with use causing nonuniform movement of the mandrel 30 or unequal pressure being applied to the pipe 22. Also, the bar 86 is not subjected to substantial bending moments since the upper and lower connector bars 106, 119 are substantially aligned with one another. Additionally, since no elements are welded or otherwise connected to the bar 86, the bar retains all its original spring characteristics and properties.

Once the mandrel 30 is placed in the expanded position, the external shoes 24 are then clamped into position. At this time the pipe section to be bent is placed in total compression. These large compression forces allow the pipe 22 to be bent as it is forced against the die surface 20 located above the pipe (see FIG. 1) without causing undesirable wrinkles or waves in the pipe.

After completion of the bend, the mandrel 30 is retracted and moved by activation of unit 38 longitudinally and then re-expanded in the pipe at the next portion of the pipe to be bent. The external shoes 24 are then released. The power unit 38 is again activated to move or shift the mandrel 30 and the pipe longitudinally within the apparatus housing from left to right as shown in FIG. 1. The external shoes 24 are then clamped around the pipe and the bending operation is repeated. To operate the mandrel 30, bar 86 is moved longitudinally by power unit 76. This movement applies force to each spacer assembly 88 and shoe assembly 64 causing the connector bars 106, 119 to pivot about their cross-pieces and release the toggle joint formed by the shoe assembly and return to the retracted position of FIG. 2. The mandrel is then available for repositioning within the pipe for bending the adjacent portion of the pipe if desired.

Further modifications and alternative embodiments of the apparatus of this invention will be apparent to those skilled in the art in view of this description. Accordingly this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. In an apparatus for bending pipe of the type having a housing section and an upper bending die connected to the housing section, the combination comprising:

a pair of flexible, external bending shoe assemblies carried by said housing and adapted for engaging the outer surface of a portion of the pipe to be bent;

a flexible mandrel aligned between said external bending shoe assemblies, said mandrel inserted into said pipe and adapted for engaging the inner surface of the portion of the pipe to be bent; and a positioning assembly connected to said mandrel and said housing, said assembly arranged to accurately position the mandrel within the pipe and selectively position the pipe with respect to said apparatus.

2. The pipe bending apparatus of claim 1, the positioning assembly including:

a drive shaft connected to said mandrel and extending longitudinally for said pipe;

a drive means attached to said shaft for moving said shaft and mandrel in a longitudinal direction; and an external support bracket connected to said housing section, said drive means mounted on said bracket whereby said pipe is positioned relative to said housing section by activating said drive means when said mandrel is engaged with the pipe.

3. The pipe bending apparatus of claim 1, the mandrel including:

a frame section;

a power supply unit attached to said frame;

an elongated, flexible strap having one end coupled to the power supply unit; and a plurality of internal shoe assemblies slidably mounted on said strap, each of said internal shoe assemblies adapted to move in a toggle-type action and engage the inside surface of said pipe upon movement of said strap.

4. The apparatus as defined in claim 3 wherein the mandrel further includes a plurality of spacer assemblies slidably mounted on said strap and interposed between each of said shoe assemblies.

5. The apparatus as claimed in claim 3, each internal shoe assembly including:

a pair of internal shoes; and a pair of spacer blocks pivotally mounted between said internal shoes, each of said blocks having a transverse slot into which said internal shoes are mounted.

6. The apparatus as claimed in claim 5, each internal shoe including:

an arcuate plate for engaging the inside surface of the pipe during bending operations; and a connector bar pivotally connected between said plate and said spacer blocks, said connector bars and said spacer blocks forming a passage through which said strap is passed.

7. An improved mandrel for engaging the inside surface of a pipe, the mandrel of the type having a frame section, a power supply unit attached thereto and an elongated, flexible bar coupled to the power unit adapted for longitudinal movement with said pipe, wherein the improvement comprises:

a plurality of internal shoe assemblies mounted for relative sliding movement on said bar, each assembly adapted for movement between an extended position and a retracted position when the bar is reciprocated by said power unit.

8. A mandrel as claimed in claim 7, including a plurality of spacer assemblies mounted for relative sliding movement on said bar and interposed between each of said internal shoe assemblies.

9. A mandrel as claimed in claim 7 wherein each internal shoe assembly includes:

a pair of internal shoes; and a pair of spacer blocks pivotally mounted between said internal shoes, each of said blocks having a transverse slot into which said internal shoes are mounted.

10. A mandrel as claimed in claim 9, each internal shoe including:

an arcuate plate for engaging the inside surface of the pipe; and a connector bar pivotally connected between said plate and said spacer blocks, said connector bars and said spacer blocks forming a passage through which said flexible bar is passed.

11. In an improved mandrel for engaging the internal surface of a pipe, the mandrel of the type having a frame section, a power supply unit attached thereto and an elongated, flexible bar coupled to the power unit and adapted for longitudinal movement within said pipe, wherein the improvement comprising, in combination:

a plurality of shoe assemblies mounted on said bar for relative sliding movement along the length of said bar, each assembly adapted for movement between an extended position and a retracted position and including;

a first arcuate plate for engaging the inner face of the upper portion of the pipe;

a first connector bar pivotally attached to the concave surface of the first arcuate plate;

a pair of spacer blocks rotatably connected to said first connector bar;

a second connector bar rotatably connected to said spacer blocks, said first and second connector bars and said spacer blocks forming a passage through which said flexible bar passes;

a second arcuate plate having its concave surface pivotally attached to said second connector bar, said second plate for engaging the inner surface of the lower portion of the pipe.

* * * * *

UNITED STATES PATENT OFFICE

CERTIFICATE OF CORRECTION

Patent No. 4,313,330 Dated February 2, 1982

Inventor(s) James D. Cummings

It is certified that error appears in the above-identified patent and that said Letters Patent are hereby corrected as shown below:

Column 6, line 26, "67" should read -- 64 --.

Column 9, line 13, "ad" should read -- as --.

Signed and Sealed this

Fourth Day of May 1982

[SEAL]

Attest:

GERALD J. MOSSINGHOFF

Attesting Officer

Commissioner of Patents and Trademarks